US006556102B1

(12) United States Patent
Sengupta et al.

(10) Patent No.: US 6,556,102 B1
(45) Date of Patent: Apr. 29, 2003

(54) RF/MICROWAVE TUNABLE DELAY LINE

(75) Inventors: Louise C. Sengupta, Warwick, MD (US); Douglas Pao, Ellicott City, MD (US); Yongfei Zhu, Columbia, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 09/712,606

(22) Filed: Nov. 14, 2000

Related U.S. Application Data

(60) Provisional application No. 60/166,267, filed on Nov. 18, 1999.

(51) Int. Cl.[7] ..... H01P 9/00
(52) U.S. Cl. ..... 333/161; 333/156
(58) Field of Search ..... 333/161, 18, 156, 333/17.1

(56) References Cited

U.S. PATENT DOCUMENTS

| | | | | |
|---|---|---|---|---|
| 3,911,382 A | | 10/1975 | Harth et al. | |
| 3,974,465 A | | 8/1976 | White | |
| 4,197,506 A | | 4/1980 | Fogelstrom | |
| 4,229,717 A | | 10/1980 | Krone et al. | |
| 4,701,714 A | | 10/1987 | Agoston | |
| 4,766,559 A | | 8/1988 | Dobos et al. | |
| 5,013,944 A | | 5/1991 | Fischer et al. | |
| 5,032,805 A | | 7/1991 | Elmer et al. | |
| 5,083,100 A | | 1/1992 | Hawkins | |
| 5,140,688 A | | 8/1992 | White et al. | |
| 5,144,173 A | | 9/1992 | Hui | |
| 5,309,125 A | * | 5/1994 | Perkins et al. | 333/160 |
| 5,312,790 A | | 5/1994 | Sengupta et al. | |
| 5,334,958 A | * | 8/1994 | Babbitt et al. | 333/156 |
| 5,355,038 A | | 10/1994 | Hui | |
| 5,369,381 A | | 11/1994 | Gamand | |
| 5,397,830 A | * | 3/1995 | Shaikh et al. | 524/494 |
| 5,406,233 A | | 4/1995 | Shih et al. | |
| 5,427,988 A | | 6/1995 | Sengupta et al. | |
| 5,465,076 A | | 11/1995 | Yamauchi et al. | |
| 5,479,139 A | | 12/1995 | Koscica et al. | |
| 5,486,491 A | | 1/1996 | Sengupta et al. | |
| 5,631,593 A | | 5/1997 | Molin | |
| 5,635,433 A | | 6/1997 | Sengupta | |
| 5,635,434 A | | 6/1997 | Sengupta | |
| 5,641,954 A | | 6/1997 | Keefer et al. | |
| 5,679,624 A | | 10/1997 | Das | |
| 5,693,429 A | | 12/1997 | Sengupta et al. | |

(List continued on next page.)

FOREIGN PATENT DOCUMENTS

| | | |
|---|---|---|
| WO | WO94/13028 | 6/1994 |

OTHER PUBLICATIONS

De Flaviis Et Al., "Low Loss Ferroelectric Based Phase Shifter for High Power Antenna Scan Beam System", Jul. 14, 1997, pp. 316–319, XP–000788405.

Burgel Et Al., Database Inspec Online!, The Institution of Electrical Engineers, Stevenage, GB, "Optical Second–Harmonic Generation at Interfaces of Ferroelectric Nanoregions in SRSIO/SUB 3/:CA SIC.SRTIO/SUB 3/:CA".

U.S. patent application Ser. No. 09/594,837, Chiu et al., filed Jun. 15, 2000.

*Primary Examiner*—Robert Pascal
*Assistant Examiner*—Kimberly E Glenn
(74) *Attorney, Agent, or Firm*—Robert P. Lenart; Michael N. Haynes; William J. Tucker

(57) ABSTRACT

A tunable delay line includes an input, an output, a first conductor electrically coupled to the input and the output, a ground conductor, and a voltage tunable dielectric layer positioned between the first conductor and the ground conductor. DC blocks and impedance matching sections are connected between the first conductor and the input and output. Additional layers of tunable dielectric material and additional conductors can be positioned in parallel with the voltage tunable layer.

32 Claims, 4 Drawing Sheets

U.S. PATENT DOCUMENTS 5,760,661 A 6/1998 Cohn
5,766,697 A 6/1998 Sengupta et al.
5,830,591 A 11/1998 Sengupta et al.
5,846,893 A 12/1998 Sengupta et al.
5,900,762 A 5/1999 Ramakrishnan
5,923,197 A 7/1999 Arkin
5,933,039 A 8/1999 Hui et al.
6,043,722 A 3/2000 Vaninetti et al.
6,232,251 B1 * 5/2001 Terashi et al. ..... 501/5
6,376,889 B1 * 4/2002 Maeda et al. ..... 257/419

* cited by examiner

RF/MICROWAVE TUNABLE DELAY LINE

CROSS REFERENCE TO RELATED APPLICATION

This application claims the benefit of the filing date of U.S. Provisional Application No. 60/166,267, filed Nov. 18, 1999.

FIELD OF INVENTION

The present invention relates to electronic delay lines, and more particularly to such delay lines that can be controlled to provide a controllable delay.

BACKGROUND OF INVENTION

Electronic delay lines are used in many devices to delay the transmission of an electric signal. To achieve changes in the delay, some delay lines add or subtract delay elements to achieve different delay times, or adjust the corresponding delay elements in a delay line chain to obtain the desired delay time. The element tolerances need to be calibrated, and the choice is limited. One needs prior knowledge of the system to choose the elements necessary for proper delay time. Some programmable delay lines use analog-to-digital and digital-to-analog converter circuits to digitally control the delay time. The structure is rather complicated. In addition, the speed for digital conversion is slow. Also most importantly, such digital circuits typically cannot operate at microwave frequencies.

There are many applications for tunable delay lines. An example, of an application for such tunable delay lines is the feed-forward amplifier. Because of their superior linearity, feed-forward amplifiers are widely used in telecommunications. The theory for achieving such linearity is described as follows. A two-tone signal is fed into a power splitter. One output path from the power splitter is connected to an amplifier and the other output path is connected to a delay line. The output of the amplifier will have a certain delay time, signal gain, intermodulation products, and a 180-degree phase shift. The output of the delay line is still a linear signal without phase shift or intermodulation products. By setting the same delay time for both paths, and using a hybrid coupler to couple the output of the amplifier to the output of the delay line with the same amplitude, the two-tone signal will be cancelled by the phase difference but the intermodulation products will not be cancelled. The intermodulation products will then be amplified by a second amplifier to obtain a 180 degree phase sift. Meanwhile, part of the output from the first amplifier is fed to a coupler that connects to a second delay line. The delay time of the second delay line is made equal to the delay time of the second amplifier. Finally, the output of the second amplifier is coupled to the output of the second delay line with the same amplitude of the intermodulation products. The result is that the intermodulation products are cancelled but not the two-tone signal. Therefore, a linear signal is obtained. In this type of application, the delay time needs to be accurate, reliable, and easily controlled.

Previous patents relating to tunable/adjustable delay lines include U.S Pat. Nos. 4,701,714; 4,766,559; and 5,631,593. Programmable delay lines are shown in U.S. Pats Nos. 5,933,039; 5,923,197; 5,641,954; 5,900,762; 5,465,076; 5,355,038; 5,144,173; 5,140,688; 5,013,944; and 4,197,506.

Tunable ferroelectric materials are materials whose permittivity (more commonly called dielectric constant) can be varied by varying the strength of an electric field to which the materials are subjected. Even though these materials work in their paraelectric phase above the Curie temperature, they are conveniently called "ferroelectric" because they exhibit spontaneous polarization at temperatures below the Curie temperature. Tunable ferroelectric materials including barium-strontium titanate (BST) or BST composites have been the subject of several patents.

Dielectric materials including barium strontium titanate are disclosed in U.S. Pat. No. 5,312,790 to Sengupta, et al. entitled "Ceramic Ferroelectric Material"; U.S. Pat. No. 5,427,988 to Sengupta, et al. entitled "Ceramic Ferroelectric Composite Material-BSTO—MgO"; U.S. Pat. No. 5,486,491 to Sengupta, et al. entitled "Ceramic Ferroelectric Composite Material-BSTO—$ZrO_2$"; U.S. Pat. No. 5,635,434 to Sengupta, et al. entitled "Ceramic Ferroelectric Composite Material-BSTO-Magnesium Based Compound"; U.S. Pat. No. 5,830,591 to Sengupta, et al. entitled "Multilayered Ferroelectric Composite Waveguides"; U.S. Pat. No. 5,846,893 to Sengupta, et al. entitled "Thin Film Ferroelectric Composites and Method of Making"; U.S. Pat. No. 5,766,697 to Sengupta, et al. entitled "Method of Making Thin Film Composites"; U.S. Pat. No. 5,693,429 to Sengupta, et al. entitled "Electronically Graded Multilayer Ferroelectric Composites"; and U.S. Pat. No. 5,635,433 to Sengupta, entitled "Ceramic Ferroelectric Composite Material-BSTO—ZnO". These patents are hereby incorporated by reference. A copending, commonly assigned United States patent application titled "Electronically Tunable Ceramic Materials Including Tunable Dielectric And Metal Silicate Phases", by Sengupta, filed Jun. 15, 2000, discloses additional tunable dielectric materials and is also incorporated by reference. The materials shown in these patents, especially BSTO—MgO composites, show low dielectric loss and high tunability. Tunability is defined as the fractional change in the dielectric constant with applied voltage.

Many prior art tunable delay lines have complicated tuning structures or too many tuning elements, and the tolerance of each delay element may affect repeatability and stability. There is a need for tunable delay lines that are relatively simple in structure and can be rapidly controlled over a broad frequency range of operation.

SUMMARY OF THE INVENTION

Tunable delay lines constructed in accordance with this invention include an input, an output, a first conductor electrically coupled to the input and the output, a ground conductor, and a voltage tunable dielectric layer positioned between the first conductor and the ground conductor. DC blocks and impedance matching sections are connected between the first conductor and the input and output. Additional layers of tunable dielectric material and additional conductors can be positioned in parallel with the voltage tunable layer.

DETAILED DESCRIPTION OF THE INVENTION

This invention provides electronic delay lines that operate at room temperature and include voltage tunable materials. The tunable delay lines can be constructed using microstrip, coplanar or waveguide structures. When a DC tuning voltage is applied to the tunable material, the dielectric constant of the material changes, which causes a change in the group velocity and therefore produces a controllable delay time in the delay line.

Figure 1:
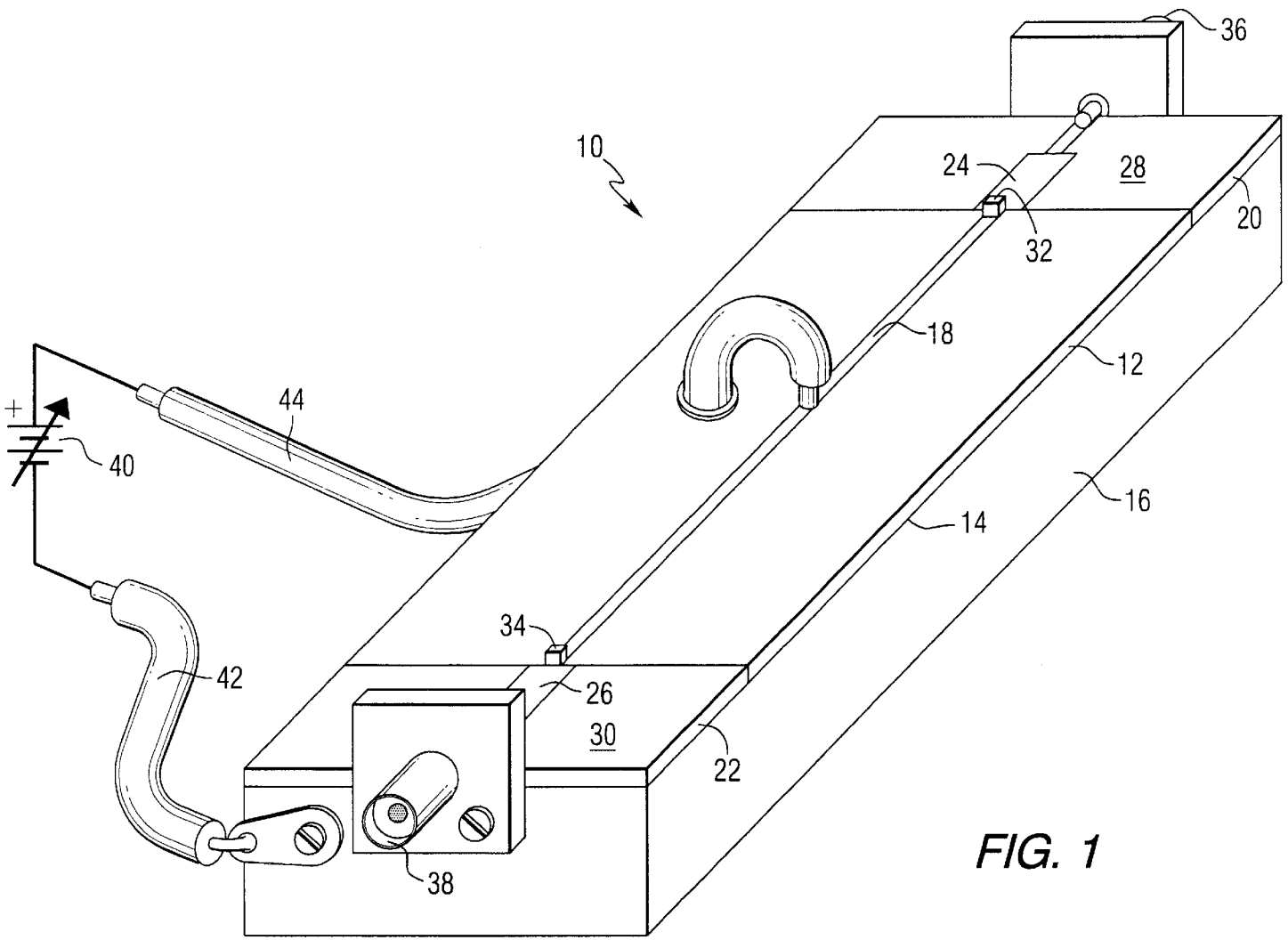
FIG. 1 is an isometric view of a tunable dielectric delay line constructed in accordance with a first embodiment of the invention.

Referring to the drawings, FIG. 1 is an isometric view of a tunable microstrip delay line 10 constructed in accordance with a first embodiment of the invention. The delay line includes a layer of tunable high dielectric constant material 12 on a top planar surface 14 of a metal carrier 16. For the purposes of this description, a high dielectric constant is a dielectric constant in the range of 50 to 1000, and typically around 100 to 300. A conductor in the form of a microstrip 18 is positioned on a surface of the tunable high dielectric constant material 12, opposite the planar surface of the metal carrier. Layers of low dielectric constant material 20 and 22 are positioned on the surface of the carrier at opposite ends of the tunable layer of high dielectric constant material 12. Impedance matching lines 24 and 26 are positioned on surfaces 28 and 30 of the layers 20 and 22 of low dielectric constant material, respectively. For the purposes of this description, a low dielectric constant is a dielectric constant less than 30, typically in the range of 2 to 10. The impedance matching lines are coupled to the ends of tunable delay line section 18 by DC block capacitors 32 and 34. Connectors 36 and 38 serve as an input and an output, and are provided at the ends of lines 24 and 26 for connection to an external circuit. The metal carrier serves as a ground conductor and is connected to a controllable voltage source 40 by conductor 42. Conductor 44 connects the tunable section to the voltage source. By controlling the voltage applied to the microstrip line 18, the dielectric constant of the tunable layer 12 can be controlled. By controlling the dielectric constant, the delay of a signal passing through the delay line can be controlled. The DC blocks can be any of a microstrip chip capacitor, a coupled microstrip line, or a microstrip filter.

In the preferred embodiment the tunable dielectric layer is preferably comprised of Barium-Strontium Titanate, $Ba_xSr_{1-x}TiO_3$ (BSTO), where x can range from zero to one, or BSTO-composite ceramics. Examples of such BSTO composites include, but are not limited to: BSTO—MgO, BSTO—$MgAl_2O_4$, BSTO—$CaTiO_3$, BSTO—$MgTiO_3$, BSTO—$MgSrZrTiO_6$, and combinations thereof. Other tunable dielectric materials may be used partially or entirely in place of barium strontium titanate. An example is $Ba_xCa_{1-x}TiO_3$, where x ranges from 0.2 to 0.8, and preferably from 0.4 to 0.6. Additional alternative tunable ferroelectrics include $Pb_xZr_{1-x}TiO_3$ (PZT) where x ranges from 0.05 to 0.4, lead lanthanum zirconium titanate (PLZT), lead titanate ($PbTiO_3$), barium calcium zirconium titanate ($BaCaZrTiO_3$), sodium nitrate ($NaNO_3$), $KNbO_3$, $LiNbO_3$, $LiTaO_3$, $PbNb_2O_6$, $PbTa_2O_6$, $KSr(NbO_3)$, and $NaBa_2(NbO_3)_5$ and $KH_2PO_4$. In addition, the present invention can include electronically tunable materials having at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$-$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $KAlSi_3O_8$, $NaAlSi_3O_8$, $CaAl_2Si_2O_8$, $CaMgSi_2O_6$, $BaTiSi_3O_9$ and $Zn_2SiO_4$. The above tunable materials can be tuned at room temperature by controlling an electric field that is applied across the materials.

In an example embodiment of the invention, the tunable section of the delay line includes a low impedance microstrip line of about 3 to 10 ohms, which is on a tunable high dielectric constant substrate layer with thickness of around 0.25 mm. The material choice in this example is BSTO—MgO. The dielectric constant of the tunable material is chosen to be about 800, so that the tunable length of a 10 nsec delay line is about 10 cm long. If the straight delay line is changed to an S shaped line then the length of the device can be further reduced. The length of the tunable delay line is calculated as:

$$L = \frac{c \cdot t}{\sqrt{\varepsilon_{rl}}}$$

The tuning range of the delay line is defined as:

$$\Delta t = \frac{1}{c} \cdot \left(\sqrt{\varepsilon_{rl}} - \sqrt{\varepsilon_{r2}}\right)$$

Here, t is the delay time of the tunable delay line and c is the speed of light. $\epsilon_{rl}$ and $\epsilon_{r2}$ are the zero biased, and fully biased dielectric constants respectively. The width of the microstrip line conductor 18 in the tunable delay line affects the impedance. When a high dielectric constant material is used, a thin microstrip line can be only a fraction of an ohm or a few ohms. For easier impedance matching, one should choose the thinner line to get higher impedance. However, the effective tunability is proportional to W/H, where W is the width of the tunable delay line, and H is the thickness of the tunable material. Because of the fringing effect of the delay line, the material biased underneath a thin microstrip line cannot be tuned effectively. Therefore, the choice between impedance and tunability is a trade off.

Two sections of quarter-wave length lines 24 and 26 at the input and output provide matched impedance to the center tunable delay line 18. The circuit is matched to 50 ohms at the input and the output with about 30% bandwidth. The dielectric material 20 and 22 in the matching sections is not tunable. In the illustrated embodiment, these materials are low dielectric constant substrates such as Duroid or another type of material. In one embodiment, the matching section materials 20 and 22 have a dielectric constant of about 10 with the same thickness as the center tunable line layer 12. The total circuit delay time for this example is about 10 nsec with +0.3 nsec tuning. The tunable delay line is symmetrical with respect to the center of the assembly. The two matching section conductors 24 and 26 connect the input port (or the output port) to the center microstrip line 18. Both matching sections are a quarter wavelength long and have different impedances. The matching sections contribute about 0.5 nsec of fixed delay time. Therefore, the tunable section should contribute a delay of 9.5 nsec. The tuning voltage required is about 100 to 500 volts, which is based on 40% tuning, and the tuning voltage is proportional to its thickness of the tunable layer. The electric field applied to the tunable layer can range from about 2 volts per $\mu$m to 8 volts per $\mu$m. The tuning voltage is connected to the center line by a coax cable 44. Two DC blocks 32 and 34 are used to couple the microstrip line to the input and the output. Alternatively, at higher frequencies, filters or couplers may be used to act as DC blocks.

Figure 2:
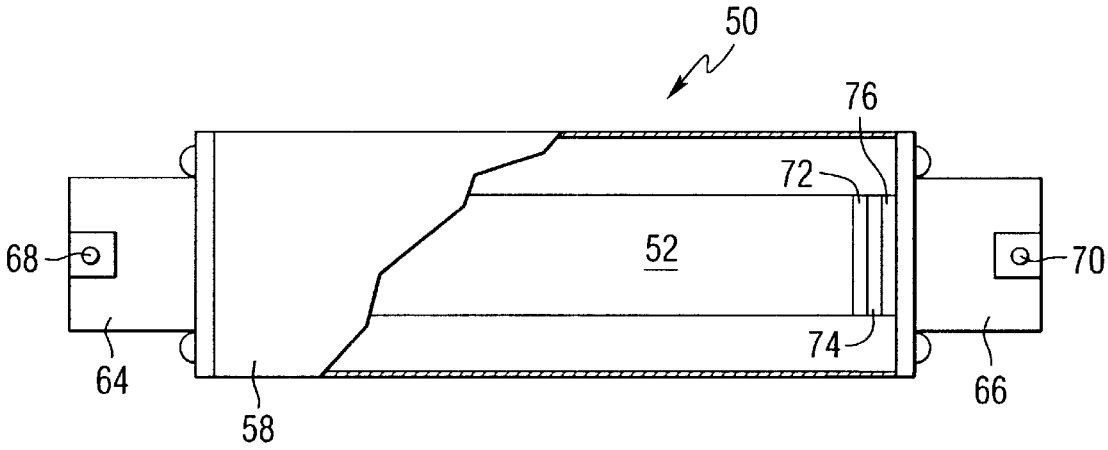
FIG. 2 is a top plan view of another embodiment of the invention.
Figure 3:
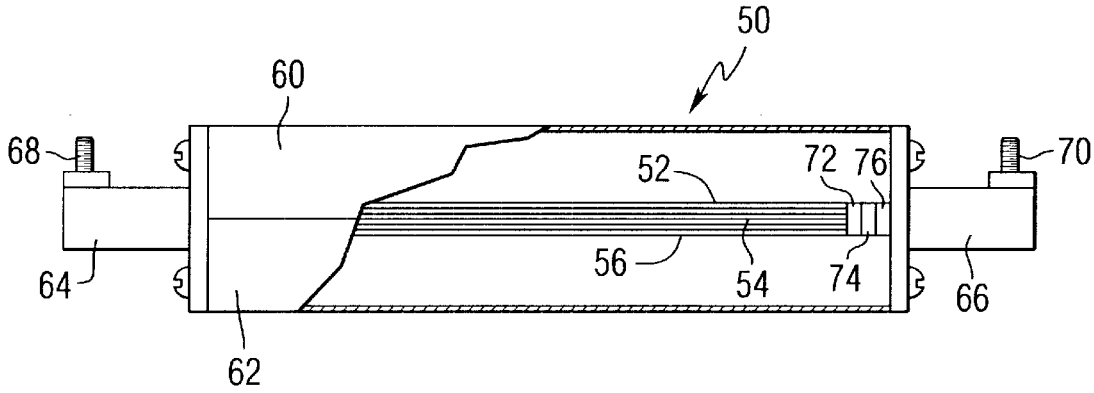
FIG. 3 is a side elevation view of the delay line of FIG. 2.

FIGS. 2 and 3 are top plan and elevation views of another embodiment of the invention. These figures illustrate a waveguide tunable delay line 50 with the same delay time and using the same materials as described with respect to the delay line of FIG. 1. The waveguide tunable delay line 50 includes a plurality of layers 52, 54, 56 of tunable dielectric material positioned to extend in an axial direction within a waveguide 58 housing. The waveguide housing includes an upper half 60 and a lower half 62. Adapters 64 and 66 extend from opposite ends of the waveguide and support connectors 68 and 70 respectively. A plurality of ceramic matching sections 72, 74 and 76 are positioned at each end of the layers of tunable dielectric material.

Figure 4:
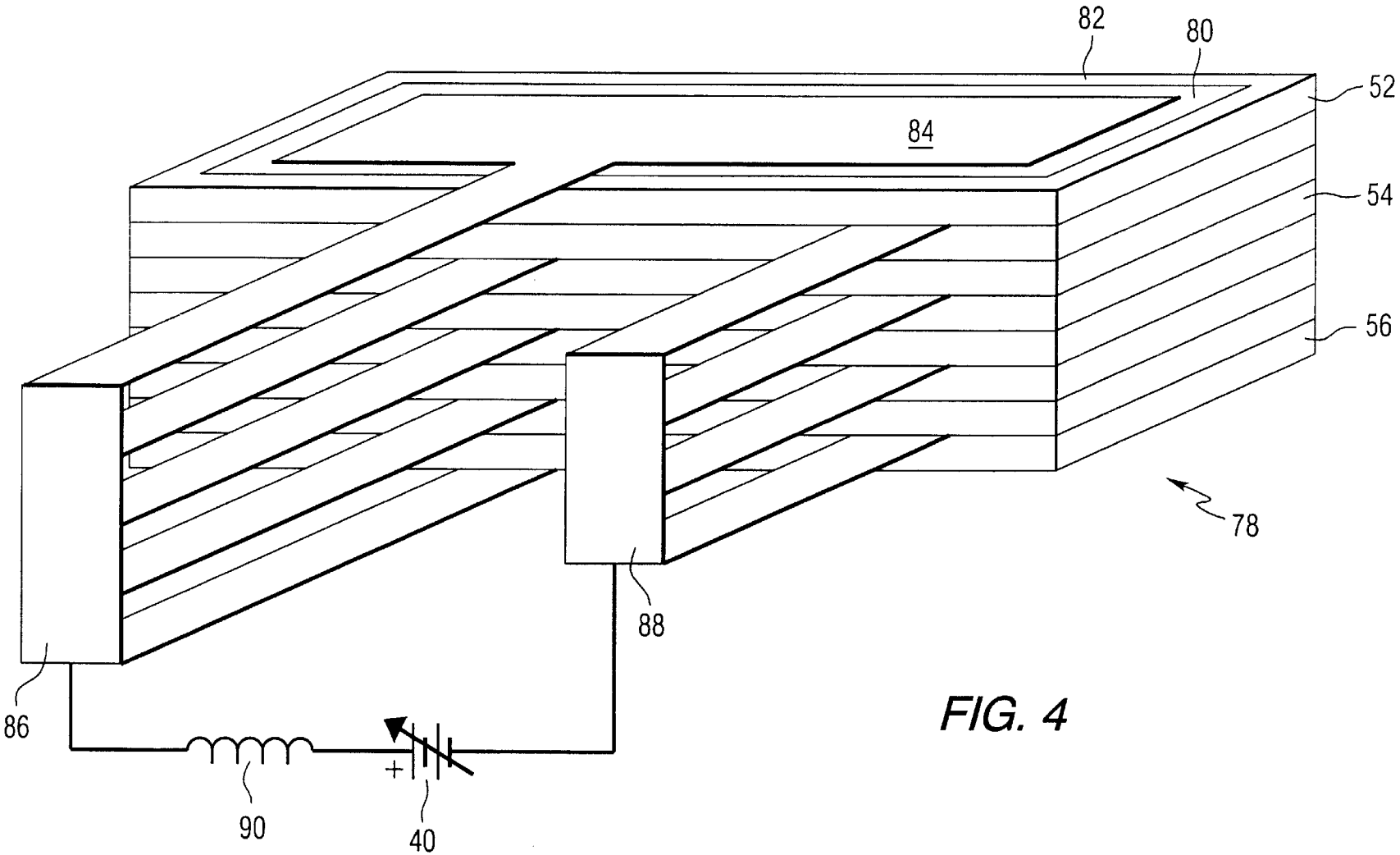
FIG. 4 is an isometric view of a stack of layers of tunable dielectric materials such as can be included in the waveguide tunable delay line of FIGS. 2 and 3.

FIG. 4 is an isometric view of a stack 78 of layers of tunable dielectric materials such as can be included in the waveguide tunable delay line of FIGS. 2 and 3. The stack 78 includes eight layers of tunable dielectric material, several of which are numbered as items 52, 54 and 56. Typically the layers would be the same material. However, special applications might exist such that mixing different materials could compensate for some performance parameters. Electrodes are provided on each side of the stack and between the layers so that the DC control voltage can be applied to the layers to control their dielectric constants. In this embodiment, electrode 80 on the top surface of the stack is a plated layer of gold with thickness of 3 $\mu$m that covers the top surface of layer 52 except for a portion of the surface near the edges thereof, referred to as a margin 82. The margin is included to avoid voltage breakdown at the edges of the stack. A copper shim 84 is used to couple the control voltage to the plated electrode. Similar plated electrodes and shims are positioned on the bottom surface of the stack and between the layers. A control voltage feed assembly 86 is used to connect the positive control voltage to the top and bottom electrodes and to electrodes between alternate layers. A ground connection assembly 88 is used to connect to similar electrodes between alternate layers. The electrodes serve as ground conductors.

In one embodiment of the invention, the layer thickness is about 1 mm and 10 layers are used in the stack. The delay line input and output matches a WR430 waveguide, which then matches to the waveguide and to the coaxial adapter. The total insertion loss including adapters is approximately 2 to 3 dB. The center tunable line can be 100 mm to 300 mm long based on the delay time required, and in turn the material chosen. Each layer's top and bottom are metalized for introducing tuning voltage. Usually, one side of the layer onto which positive voltage is applied, will have a margin at each edge in order to avoid high voltage breakdown.

The impedance matching sections 72, 74 and 76 are non-tunable ceramic materials that can have different dielectric constants and may be different thickness. These sections connect to the stack of tunable dielectric layers in the center tunable section to the input and the output. Depending on bandwidth, loss and VSWR requirements, the matching can include from 2 to 5 sections. The waveguide should make a tight fit for the ceramic materials. However, indium foil can be used to fill up all air gaps. The indium foil acts as an extension of the waveguide walls to squeeze out air between the ceramic and the waveguide walls. The tuning voltage is introduced through a thin coax cable structure from one side of the waveguide. A low pass filter 90 may be added to the control voltage circuit to block signal leakage, particularly at higher frequencies.

This invention includes, tunable/adjustable delay lines that are fabricated using a voltage tunable dielectric material. When the tuning voltage is applied to an electrode positioned adjacent to the tunable material, the dielectric constant of the material is decreased. The rate of change is approximately linear. The tunability is defined as: tunability $=(\epsilon_{r1}-\epsilon_{r2})/\epsilon_{r1}$. Here, $\epsilon_{r1}$ is the material dielectric constant before applying the tuning voltage and $\epsilon_{r2}$ is the dielectric constant after tuning. By choosing the proper dielectric constant, tuning range and loss tangent, the delay lines can be constructed that operate in a frequency range from 800 MHz to 40 GHz. The delay lines of this invention can be electronically tuned to reach the accuracy of a fraction of a nanosecond, which is repeatable and stable. Since the tunable material is a good insulator, the DC power consumption of the tuning voltage supply is very low, with a current far less than a milliampere. The voltage tuned delay lines have the advantage of fast tuning, good tunability, small size, simple control circuits, low power consumption, and low cost. In addition, the delay lines show good linear behavior and can be radiation hardened.

In order to satisfy the need for adjustable delay time, such as for example in the feed-forward amplifier, the present invention uses a voltage tunable material to make tunable delay lines. The invention can take the form of a microstrip delay line or a multi-layer of tunable material filled waveguide delay line. For tuning the delay line, a biasing DC voltage is applied across the tunable material and the voltage is adjusted until the desired time delay is obtained. Tuning and settling time are in the nano-second range. The tuning structure is simple and reliable. The delay lines of this invention can also be constructed in a coplanar format.

Figure 5:
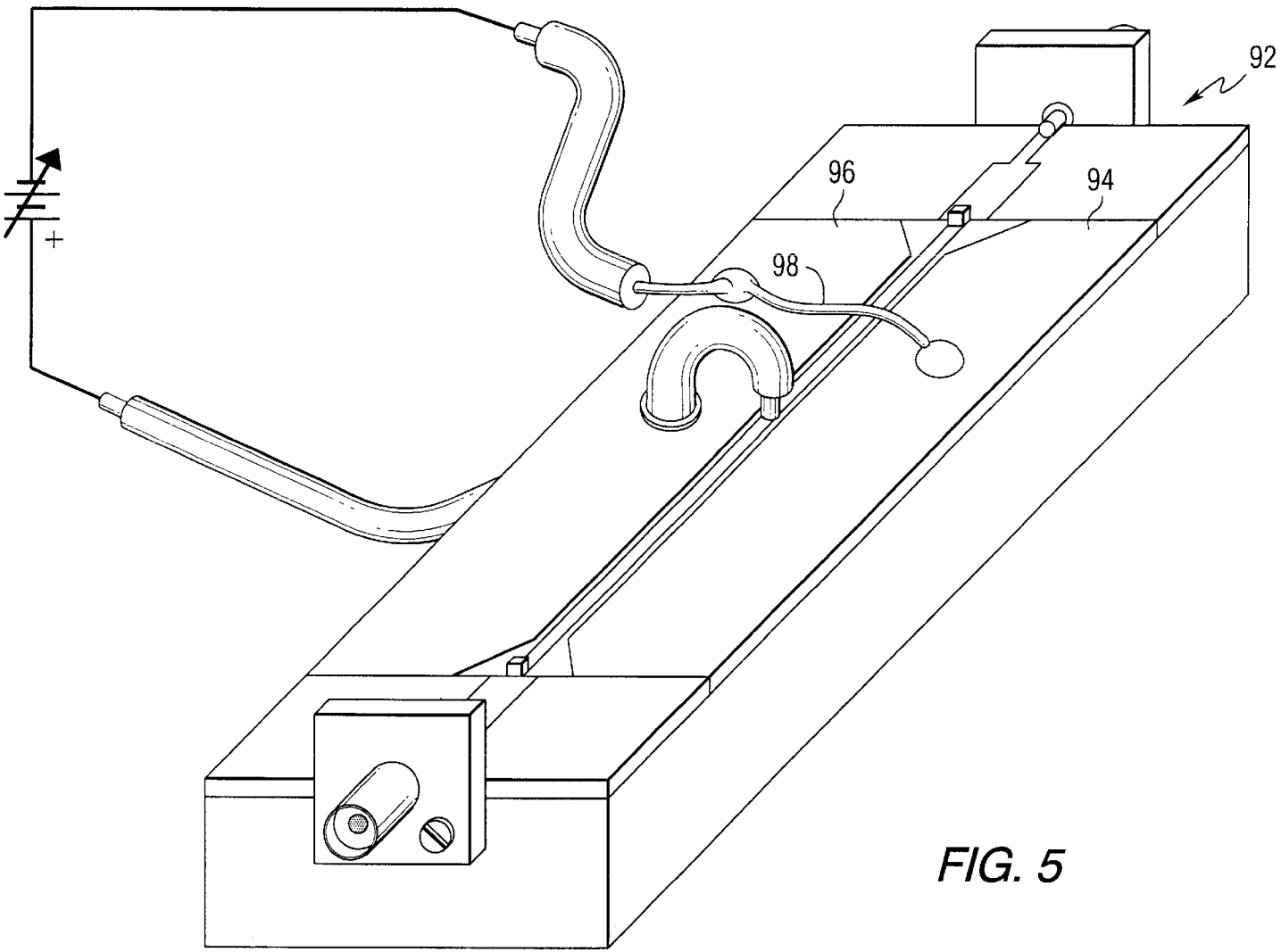
FIG. 5 is an isometric view of a tunable dielectric delay line constructed in accordance with another embodiment of the invention.

FIG. 5 is an isometric view of a coplanar tunable dielectric delay line 92 constructed in accordance with the invention. In FIG. 5, the metallized microstrip center line is connected to the tuning voltage as in FIG. 1. Ground plane electrodes 94 and 96 are mounted on the surface of the tunable dielectric material and are positioned to form two parallel gaps between the microstrip and the ground plane electrodes. The ground plane electrodes are connected to the ground through conductor 98. A voltage applied between the center microstrip conductor and the ground plane electrodes is used to control the dielectric constant of the tunable material in the vicinity of the gaps, and to thereby control the delay time of a signal passing through the center line. In this embodiment, the tunable ceramic is a thick film that has been screen printed on a substrate base before the metallization. The base material can be a non-tunable low loss ceramic. The frequency of the delay lines depends upon the material, and can range from 800 MHz to 40 GHz.

The present invention takes advantage of low loss voltage tunable materials to build tunable delay lines that vary the dielectric constant by a change of voltage across the material. The waveguide delay line is made of multiple layers of tunable material. The dielectric constant can be selected form a range of 30 to 1000. For the low frequency and small size requirement, one can choose a higher dielectric constant material because the signal wavelength in such a material will be much shorter. For the high frequency, the wavelength in the high dielectric constant material is too small.

Therefore, one should choose low dielectric constant material. The choice of thickness for the dielectric material is a tradeoff among loss, mechanical strength, and tuning voltage. Thinner material requires less tuning voltage, but thinner material has increased losses and lower mechanical strength. A design tradeoff between size, tunability and the loss requirement is therefore exercised. When multi-layer structures are used, the tuning voltage range will be considered only for the single layer. This structure allows one to use thicker material by layering without increasing the control voltage. In the design process, the increase of thickness can also provide an increase of characteristic impedance to provide better impedance matching. The same tunable dielectric constant material can be used for the microstrip delay line. For the same delay time, the microstrip delay line will be lossier. However, it will be smaller in overall width and height. Other methods can be used to implement the tunable delay line, such as a delay line fabricated on a tunable, thick or thin film that is deposited on the surface of a low loss non-tunable ceramic.

The present invention provides a DC voltage linearly tunable delay line, which can be rapidly controlled by a computer program. The delay lines can operate over a broad frequency range. As examples, three delay lines have been described. The first embodiment is a microstrip line structure. The second embodiment is a waveguide filled with bulk tunable ceramic material. Both the first and second embodiments operate in the L-band frequency range. The third embodiment is the example of coplanar structure delay line.

By using the present tunable delay line in feed-forward amplifiers, accurate time delays will be easier to obtain by tuning a DC voltage. The delay time versus tuning voltage is an approximately linear relationship. In addition, high power applications can be realized by using a waveguide structure delay line.

While the present invention has been described in terms of what are at present believed to be its preferred embodiments, it will be apparent to those skilled in the art that various changes may be made to the disclosed embodiments without departing from the scope of the invention as defined by the following claims.

What is claimed is:

1. A tunable delay line comprising;

an input;

an output;

a first conductor electrically coupled to the input and the output;

a ground conductor; and a voltage tunable dielectric layer positioned between the first conductor and the ground conductor;

wherein the voltage tunable dielectric material has a loss tangent in the range of 0.001 to 0.01 at frequencies in a range of 800 MHz to 40 GHz.

2. A tunable delay line according to claim 1, further comprising:

a circuit for applying a control voltage between the first conductor and the ground conductor.

3. A tunable delay line according to claim 1, further comprising;

a first DC block connected between a first end of the first conductor and the input; and a second DC block connected between a second end of the first conductor and the output.

4. A tunable delay line according to claim 3, wherein each of the first and second DC blocks comprises one of:

a microstrip chip capacitor;

a coupled microstrip line; and a microstrip filter.

5. A tunable delay line according to claim 1, further comprising:

a first impedance matching section connected between a first end of the first conductor and the input; and a second impedance matching section connected between a second end of the first conductor and the output.

6. A tunable delay line according to claim 5, wherein each of the impedance matching sections comprises:

a quarter-wave length microstrip conductor on a non-tunable low dielectric constant substrate.

7. A tunable delay line according to claim 5, wherein each of the impedance matching sections matches 50 ohms at the input and the output.

8. A tunable delay line according to claim 1, wherein the tunable dielectric layer comprises a material selected from the group of:

barium strontium titanate, barium calcium titanate, lead zirconium titanate, lead lanthanum zirconium titanate, lead titanate, barium calcium zirconium titanate, sodium nitrate, $KNbO_3$, $LiNbO_3$, $LiTaO_3$, $PbNb_2O_6$, $PbTa_2O_6$, $KSr(NbO_3)$, NaBa2(NbO3)$_5$, $KH_2PO_4$, and composites thereof.

9. A tunable delay line according to claim 1, wherein the tunable dielectric layer comprises a barium strontium titanate (BSTO) composite selected from the group of:

BSTO—MgO, BSTO—$MgAl_2O_4$, BSTO—$CaTiO_3$, BSTO—$MgTiO_3$, BSTO—$MgSrZrTiO_6$, and combinations thereof.

10. A tunable delay line according to claim 1, wherein the tunable dielectric layer comprises a material selected from the group of:

$Mg_2SiO_4$, $CaSiO_3$, $BaSiO_3$, $SrSiO_3$, $Na_2SiO_3$, $NaSiO_3$-$5H_2O$, $LiAlSiO_4$, $Li_2SiO_3$, $Li_4SiO_4$, $Al_2Si_2O_7$, $ZrSiO_4$, $KAlSi_3O_8$, $NaAlSi_3O_8$, $CaAl_2Si_2O_8$, $CaMgSi_2O_6$, $BaTiSi_3O_9$ and $Zn_2SiO_4$.

11. A tunable delay line comprising:

an input;

an output;

a first conductor electrically coupled to the input and the output;

a ground conductor; and a voltage tunable dielectric layer positioned between the first conductor and the ground conductor, the voltage tunable dielectric comprising a material having a loss tangent in the range of 0.001 to 0.01 at frequencies in a range of 800 MHz to 40 GHz;

wherein the first conductor comprises a metalized layer microstrip line.

12. A tunable delay line according to claim 11, wherein the tunable dielectric layer comprises a material selected from the group of:

barium strontium titanate, barium calcium titanate, lead zirconium titanate, lead lanthanum zirconium titanate, lead titanate, barium calcium zirconium titanate, sodium nitrate, $KNbO_3$, $LiNbO_3$, $LiTaO_3$, $PbNb_2O_6$, $PbTa_2O_6$, $KSr(NbO_3)$, $NaBa_2(NbO_3)_5$, $KH_2PO_4$, and composites thereof.

13. A tunable delay line according to claim 11, wherein the tunable dielectric layer comprises a barium strontium titanate (BSTO) composite selected from the group of:

BSTO—MgO, BSTO—$MgAl_2O_4$, BSTO—$CaTiO_3$, BSTO—$MgTiO_3$, BSTO—$MgSrZrTiO_6$, and combinations thereof.

14. A tunable delay line according to claim 11, wherein the tunable dielectric layer comprises a material selected from the group of:

$Mg_2SiO_4$, $CaSiO_3$, $BaSiO_3$, $SrSiO_3$, $Na_2SiO_3$, $NaSiO_3$-$5H_2O$, $LiAlSiO_4$, $Li_2SiO_3$, $Li_4SiO_4$, $Al_2Si_2O_7$, $ZrSiO_4$, $KAlSi_3O_8$, $NaAlSi_3O_8$, $CaAl_2Si_2O_8$, $CaMgSiO_6$, $BaTiSi_3O_9$ and $Zn_2SiO_4$.

15. A tunable delay line comprising:

an input;

an output;

a first conductor electrically coupled to the input and the output;

a ground conductor;

a voltage tunable dielectric layer positioned between the first conductor and the ground conductor, the voltage tunable dielectric comprising a material having a loss tangent in the range of 0.001 to 0.01 at frequencies in a range of 800 MHz to 40 GHz; and a housing containing the first conductor, the ground conductor, and the voltage tunable dielectric layer.

16. A tunable delay line according to claim 15, wherein the housing comprises:

a machined aluminum waveguide.

17. A tunable delay line according to claim 15, wherein the tunable dielectric layer comprises a material selected from the group of:

barium strontium titanate, barium calcium titanate, lead zirconium titanate, lead lanthanum zirconium titanate, lead titanate, barium calcium zirconium titanate, sodium nitrate, $KNbO_3$, $LiNbO_3$, $LiTaO_3$, $PbNb_2O_6$, $PbTa_2O_6$, $KSr(NbO_3)$, $NaBa_2(NbO_3)_5$, $KH_2PO_4$, and composites thereof.

18. A tunable delay line according to claim 15, wherein the tunable dielectric layer comprises a barium strontium titanate (BSTO) composite selected from the group of:

BSTO—MgO, BSTO—$MgAl_2O_4$, BSTO—$CaTiO_3$, BSTO—$MgTiO_3$, BSTO—$MgSrZrTiO_6$, and combinations thereof.

19. A tunable delay line according to claim 15, wherein the tunable dielectric layer comprises a material selected from the group of:

$Mg_2SiO_4$, $CaSiO_3$, $BaSiO_3$, $SrSiO_3$, $Na_2SiO_3$, $NaSiO_3$-$5H_2O$, $LiAlSiO_4$, $Li_2SiO_3$, $Li_4SiO_4$, $Al_2Si_2O_7$, $ZrSiO_4$, $KAlSi_3O_8$, $NaAlSi_3O_8$, $CaAl_2Si_2O_8$, $CaMgSi_2O_6$, $BaTiSi_3O_9$ and $Zn_2SiO_4$.

20. A tunable delay line comprising:

an input;

an output;

a first conductor electrically coupled to the input and the output;

a ground conductor;

a voltage tunable dielectric layer positioned between the first conductor and the ground conductor;

a plurality of additional layers of tunable dielectric material; and a plurality of additional electrodes for applying control voltage to the plurality of additional layers of tunable dielectric material.

21. A tunable delay line according to claim 20, further comprising:

a first bulk ceramic impedance matching section connected between a first end of the plurality of additional layers of tunable dielectric materials and the input; and a second bulk ceramic impedance matching section connected between a second end of the plurality of additional layers of tunable dielectric materials and the output.

22. A tunable delay line according to claim 21, wherein the first and second bulk ceramic impedance matching sections comprise:

a low dielectric constant, non-tunable, quarter-wave length long, bulk ceramic.

23. A tunable delay line according to claim 20, wherein the tunable dielectric layer comprises a material selected from the group of:

barium strontium titanate, barium calcium titanate, lead zirconium titanate, lead lanthanum zirconium titanate, lead titanate, barium calcium zirconium titanate, sodium nitrate, $KNbO_3$, $LiNbO_3$, $LiTaO_3$, $PbNb_2O_6$, $PbTa_2O_6$, $KSr(NbO_3)$, $NaBa_2(NbO_3)_5$, $KH_2PO_4$, and composites thereof.

24. A tunable delay line according to claim 20, wherein the tunable dielectric layer comprises a barium strontium titanate (BSTO) composite selected from the group of:

BSTO—MgO, BSTO—$MgAl_2O_4$, BSTO—$CaTiO_3$, BSTO—$MgTiO_3$, BSTO—$MgSrZrTiO_6$, and combinations thereof.

25. A tunable delay line according to claim 20, wherein the tunable dielectric layer comprises a material selected from the group of:

$Mg_2SiO_4$, $CaSiO_3$, $BaSiO_3$, $SrSiO_3$, $Na_2SiO_3$, $NaSiO_3$-$5H_2O$, $LiAlSiO_4$, $Li_2SiO_3$, $Li_4SiO_4$, $Al_2Si_2O_7$, $ZrSiO_4$, $KAlSi_3O_8$, $NaAlSi_3O_8$, $CaAl_2Si_2O_8$, $CaMgSi_2O_6$, $BaTiSi_3O_9$ and $Zn_2SiO_4$.

26. A tunable delay line comprising:

an input;

an output;

a first conductor electrically coupled to the input and the output;

a ground conductor; and a voltage tunable dielectric layer positioned between the first conductor and the ground conductor;

wherein the ground conductor comprises first and second electrodes lying parallel to the first conductor.

27. A tunable delay line according to claim 26, wherein the first and second electrodes and the first conductor are mounted on a surface of the voltage tunable dielectric layer.

28. A tunable delay line according to claim 26, wherein the tunable dielectric layer comprises a material selected from the group of:

barium strontium titanate, barium calcium titanate, lead zirconium titanate, lead lanthanum zirconium titanate, lead titanate, barium calcium zirconium titanate, sodium nitrate, $KNbO_3$, $LiNbO_3$, $LiTaO_3$, $PbNb_2O_6$, $PbTa_2O_6$, $KSr(NbO_3)$, $NaBa_2(NbO_3)_5$, $KH_2PO_4$, and composites thereof.

29. A tunable delay line according to claim 26, wherein the tunable dielectric layer comprises a barium strontium titanate (BSTO) composite selected from the group of:

BSTO—MgO, BSTO—$MgAl_2O_4$, BSTO—$CaTiO_3$, BSTO—$MgTiO_3$, BSTO—$MgSrZrTiO_6$, and combinations thereof.

30. A tunable delay line according to claim 26, wherein the tunable dielectric layer comprises a material selected from the group of:

$Mg_2SiO_4$, $CaSiO_3$, $BaSiO_3$, $SrSiO_3$, $Na_2SiO_3$, $NaSiO_3$-$5H_2O$, $LiAlSiO_4$, $Li_2SiO_3$, $Li_4SiO_4$, $Al_2Si_2O_7$, $ZrSiO_4$, $KAlSi_3O_8$, $NaAlSi_3O_8$, $CaAl_2Si_2O_8$, $CaMgSi_2O_6$, $BaTiSi_3O_9$ and $Zn_2SiO_4$.

31. A tunable delay line comprising:

an input;

an output;

a first conductor electrically coupled to the input and the output;

a ground conductor; and a voltage tunable dielectric layer positioned between the first conductor and the ground conductor;

wherein the tunable dielectric layer comprises a material selected from the group of: barium calcium titanate, lead zirconium titanate, lead lanthanum zirconium titanate, lead titanate, barium calcium zirconium titanate, sodium nitrate, $KNbO_3$, $LiNbO_3$, $LiTaO_3$, $PbNb_2O_6$, $PbTa_2O_6$, $KSr(NbO_3)$, $NaBa_2(NbO_3)_5$, $KH_2PO_4$, and composites thereof, and having a loss tangent in the range of 0.001 to 0.01 at frequencies in a range of 800 MHz to 40 GHz.

32. A tunable delay line comprising:

an input;

an output;

a first conductor electrically coupled to the input and the output;

a ground conductor; and a voltage tunable dielectric layer positioned between the first conductor and the ground conductor;

wherein the tunable dielectric layer comprises a material selected from the group of: $Mg_2SiO_4$, $CaSiO_3$, $BaSiO_3$, $SrSiO_3$, $Na_2SiO_3$, $NaSiO_3$-$5H_2O$, $LiAlSiO_4$, $Li_2SiO_3$, $Li_4SiO_4$, $Al_2Si_2O_7$, $ZrSiO_4$, $KAlSi_3O_8$, $NaAlSi_3O_8$, $CaAl_2Si_2O_8$, $CaMgSi_2O_6$, $BaTiSi_3O_9$ and $Zn_2SiO_4$, and having a loss tangent in the range of 0.001 to 0.01 at frequencies in a range of 800 MHz to 40 GHz.

* * * * *

UNITED STATES PATENT AND TRADEMARK OFFICE

CERTIFICATE OF CORRECTION

PATENT NO. : 6,556,102 B1
DATED : April 29, 2003
INVENTOR(S) : Sengupta et al.

It is certified that error appears in the above-identified patent and that said Letters Patent is hereby corrected as shown below:

Column 9,
Line 6, replace "$CaMgSiO_6$" with -- $CaMgSi_2O_6$ --

Signed and Sealed this

Twelfth Day of August, 2003

JAMES E. ROGAN
*Director of the United States Patent and Trademark Office*